US006208300B1

(12) United States Patent
Johnson

(10) Patent No.: US 6,208,300 B1
(45) Date of Patent: Mar. 27, 2001

(54) DIRECTOR ELEMENT FOR RADIO DEVICES

(75) Inventor: Greg Johnson, Aptos, CA (US)

(73) Assignee: RangeStar Wireless, Inc., Aptos, CA (US)

( * ) Notice: Subject to any disclaimer, the term of this patent is extended or adjusted under 35 U.S.C. 154(b) by 0 days.

(21) Appl. No.: 09/315,675

(22) Filed: May 20, 1999

Related U.S. Application Data

(63) Continuation of application No. PCT/US99/00484, filed on Jan. 8, 1999.
(60) Provisional application No. 60/082,973, filed on Apr. 24, 1998.

(51) Int. Cl.[7] ..... H01Q 1/24
(52) U.S. Cl. ..... 343/702; 343/833; 455/90
(58) Field of Search ..... 343/702, 906, 343/818, 819, 833, 900; 455/90; H01Q 1/24

(56) References Cited

U.S. PATENT DOCUMENTS

| | | | | |
|---|---|---|---|---|
| 3,196,442 | | 7/1965 | Leffelman et al. | 343/765 |
| 4,584,585 | | 4/1986 | Marko et al. | 343/702 |
| 4,591,863 | | 5/1986 | Patsiokas | 343/702 |
| 5,507,012 | | 4/1996 | Luxon et al. | 455/89 |
| 5,539,419 | | 7/1996 | Ogawa et al. | 343/761 |
| 5,576,720 | | 11/1996 | Gorenz, Jr. et al. | 343/702 |
| 5,585,807 | | 12/1996 | Takei | 343/702 |
| 5,666,125 | * | 9/1997 | Luxon et al. | 343/702 |
| 5,818,390 | | 10/1998 | Hill | 343/700 |
| 5,828,341 | | 10/1998 | Delamater | 343/702 |
| 5,966,099 | * | 10/1999 | Xue | 343/702 |

* cited by examiner

*Primary Examiner*—Hoanganh Le
(74) *Attorney, Agent, or Firm*—Larkin, Hoffman, Daly & Lindgren, Ltd; John F. Klos

(57) ABSTRACT

An antenna assembly for a hand-held radio transceiver, examples of which include a cellular telephone and PCS device. A multiple element antenna assembly is utilized to provide improved performance characteristics. The antenna assembly may include a conductive radiation director element and a support member for maintaining the director element in deployed and undeployed orientations. The antenna assembly may be selectively attached to a base portion of an active antenna element of a transceiver or may be pivotally secured to the transceiver.

21 Claims, 5 Drawing Sheets

DIRECTOR ELEMENT FOR RADIO DEVICES

CROSS REFERENCE TO RELATED APPLICATIONS

This application is a con US PCT/US99/00484 Jan. 8, 1999.

This application claims the benefit of priority pursuant to 35 U.S.C §119(e)(1) from the provisional patent application filed pursuant to 35 USC §111(b): as Ser. No. 60/082,973 on Apr. 24, 1998.

FIELD OF THE INVENTION

The present invention relates to an antenna assembly for a hand-held radio device, and more particularly to a parasitic director element used in conjunction with a fed whip or shortened whip-type omnidirectional antenna.

BACKGROUND OF THE INVENTION

A need remains for antenna assemblies having characteristics of improved signal strength (gain) and front-to-back ratio, and reduced susceptibility to multipath interference. There have been a number of efforts in the past to provide an antenna for a portable radio communication device for at least the purposes of signal reception and transmission. These efforts usually have involved substantial intrusions into the limited space available to the transceiver electronics or substantial additions to the housing or substantial complexity, any or all of which factors render manufacturability difficult and costly.

SUMMARY OF THE INVENTION

This disclosure relates generally to an antenna assembly for a hand-held radio-frequency transceiver, examples of which include a cellular telephone and PCS device for the 800–900 MHz or 1850–1990 MHz frequency ranges, respectively. A multiple-element antenna assembly is utilized to provide improved performance characteristics, e.g., front-to-back ratio and gain. The antenna assembly may consist of an existing fed whip or shortened whip-type omnidirectional antenna of a typical transceiver and a user-attachable antenna enhancement device. In one embodiment, the antenna enhancement device is an "after-market" director element device which may be secured to an active antenna element (e.g., monopole or whip antenna element) of a typical cellular telephone or PCS device. In another embodiment, the antenna enhancement device may be incorporated into the handset and be transitioned into an operating position during transceiver use. The antenna enhancement device may include a single parasitic director element. During transceiver use, the parasitic director element is maintained a predetermined distance away from the active antenna element by a support member which may be formed of a dielectric material. The dielectric support member may include a securement device to attach the antenna enhancement device relative to the active antenna element. The securement device may include a plurality of differently sized securement rings adapted for use on a variety of transceivers. Several purposes and objects of the disclosed apparatuses are described herein. One object of the present disclosure is to provide an antenna assembly with improved directionality and reduced absorption of radio frequency radiation to a user of a cellular telephone or a PCS device.

The present invention includes an antenna assembly designed for use with PCS devices operating in the 1850–1990 MHz frequency range. The antenna assemblies as hereinafter described can also be used for wireless communication devices, such as a cellular telephones, wireless LANs, etc. Both portable and stationary antenna assemblies may utilize aspects of the present invention. The disclosed design technique provides an antenna assembly with improved performance characteristics and physical characteristics, i.e., ruggedness, simplicity, and low cost.

The antenna assembly according to the present invention provides a performance-enhancing director element spaced a predetermined distance away from an active antenna element by a support member. In one embodiment, the antenna enhancement device may be disposed upon a distal end of a dielectric support member. In another embodiment, the director element may be fixed in length and may be substantially elongated in form. In yet another embodiment, the antenna director element may be movably attached at the back side of the radio device from the support member. In an alternative embodiment, a pivotal antenna director element may be partially received or concealed within a portion of the back side of the radio device.

Additional improvements and benefits of the antenna assembly of the present invention include:

- Increased signal strength, resulting in extended signal range and fewer dropped calls for a given power consumption rate;
- Increased battery life for a given output signal level (for battery powered units);
- Reduced radio frequency radiation incident to the user's body;
- Increased in the front-to-back ratio; and
- Reduced susceptibility to multipath interference.

The present invention has several objects. One object is to redistribute the radiation in the vicinity of the transceiver away from the user. Consistent with this object, the present invention alters the near-field radiation pattern surrounding the radio communication device. One benefit of an antenna assembly of the present invention is an attenuation in the radiation directed toward the user (and a concomitant reduction in the amount of radiated energy which is absorbed by a user) with an augmentation in the radiation directed away from the user thereby increasing the effective power of the radio transmission.

Another object of the present invention provides a radiation directing device suitable for use on or in conjunction with a variety of transceivers. The antenna enhancement device is positioned in proximity to the active antenna element on the opposite side of the antenna to the user. The materials out of which the antenna enhancement device is made may include dielectric materials, magnetically permeable materials, conductive materials, insulating materials, semiconducting materials, or combinations of these materials. The director element of the antenna enhancement device may include a conductor (which may be a wire form) and a dielectric support arm for supporting and maintaining the conductor element in proper relation to the active antenna element. In particular, polymer materials of construction of the antenna enhancement device may have, in order of preference, a dielectric constant of up to 10, or in the range of 2–3.

The antenna enhancement device according to the present invention is designed to be placed in proximity to the active antenna element, or in contact with the active element, or even form an extension of the active element. However, it can be appreciated that the director device does not act as a radiation shield so as to come between the active antenna element and the user.

In one embodiment, the present invention may take the form of an improved antenna assembly for a portable radio communication device which includes an elongate active antenna element adapted to be coupled in electrical communication to the radio device for generating a radiation field pattern. An example of such an active antenna element is a monopole or whip antenna element of a typical cellular phone or PCS device. The antenna assembly further includes a radiation director element which is disposed relative the active antenna member by a support member. During radio transmission, at least a portion of the antenna assembly's radiation field pattern is redirected away from the user by the parasitic director element. The parasitic director element may be an elongate conductive member positioned by the user in a preferred orientation generally parallel to the active antenna element.

The radio communication device radiates within a range of wavelengths corresponding to an operational bandwidth. The parasitic director element has a length of less than approximately one-half of a wavelength within the range of operational wavelengths. The parasitic director element may advantageously have a length of approximately 0.36 of a wavelength (0.36λ) for a preselected wavelength within the range of operational wavelengths. In the present invention, the parasitic director element may be a short length of conductive material generally parallel to the active antenna member on a side away from the user.

The operation and usefulness of the device of the present invention for redistributing radiation depends on many of the design parameters chosen. The present invention includes a range of shapes, thicknesses, orientations and compositions of possible devices that can be temporarily placed in the proximity of or in contact with the antenna.

The above and other objects, features, and advantages of the present invention are further disclosed in the following detailed description in conjunction with the drawings.

DESCRIPTION OF THE PREFERRED EMBODIMENTS

Figure 1:
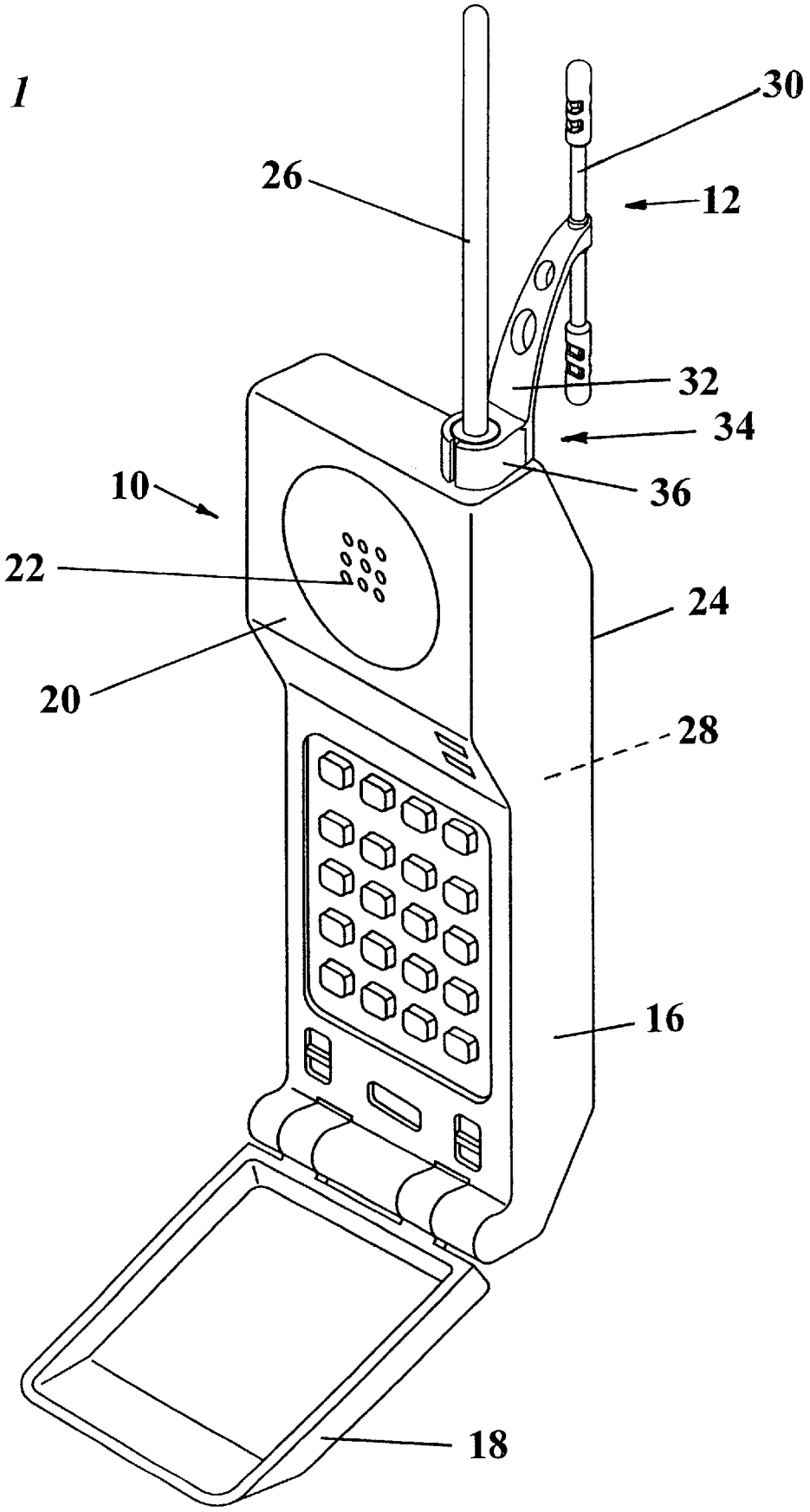
FIG. 1 is a perspective view of a cellular telephone hand-set with a director attachment of the present invention.
Figure 3:
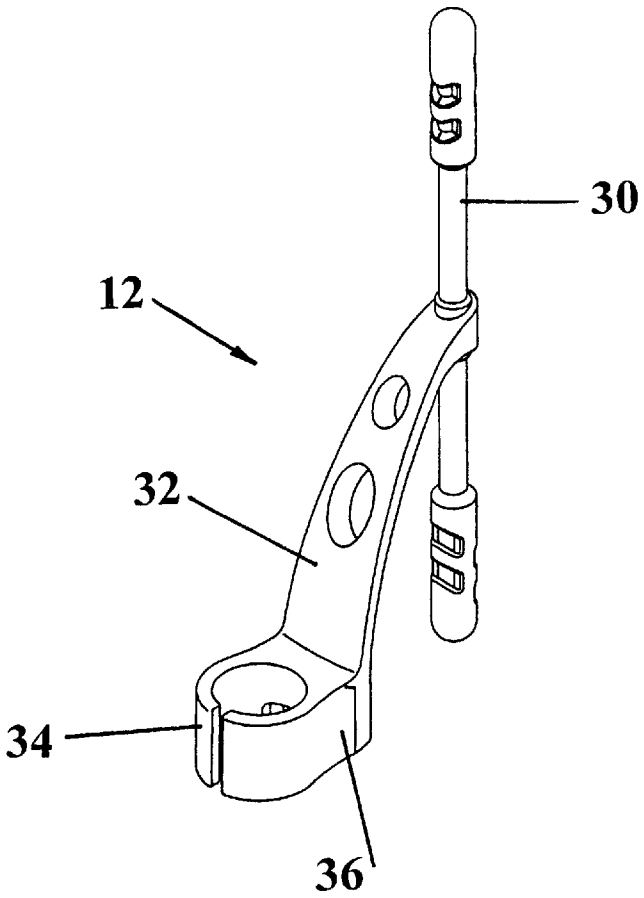
FIG. 3 is a perspective view of the antenna director element of FIG. 1.

Referring now to the drawings, where like numerals represent like parts throughout, FIG. 1 is a perspective view of a hand-held PCS device handset 10 and a preferred antenna enhancement device 12 according to the present invention. The handset 10 includes a main body portion 16 and a hinged "flip" or panel portion 18 which in FIG. 1 is depicted in its opened, operational position. Telephone handset 10 includes a front side 20 (nearer to the user) having a speaker 22 and a microphone (not shown) and a rear side 24. Handset 10 is electrically powered by a battery or battery pack (not shown). Handset 10 includes an elongate active antenna element 26 which may be a whip or monopole antenna As appreciated by those skilled in the art, the active antenna element 26 is operatively coupled to transceiver electronic elements 28.

Figure 2:
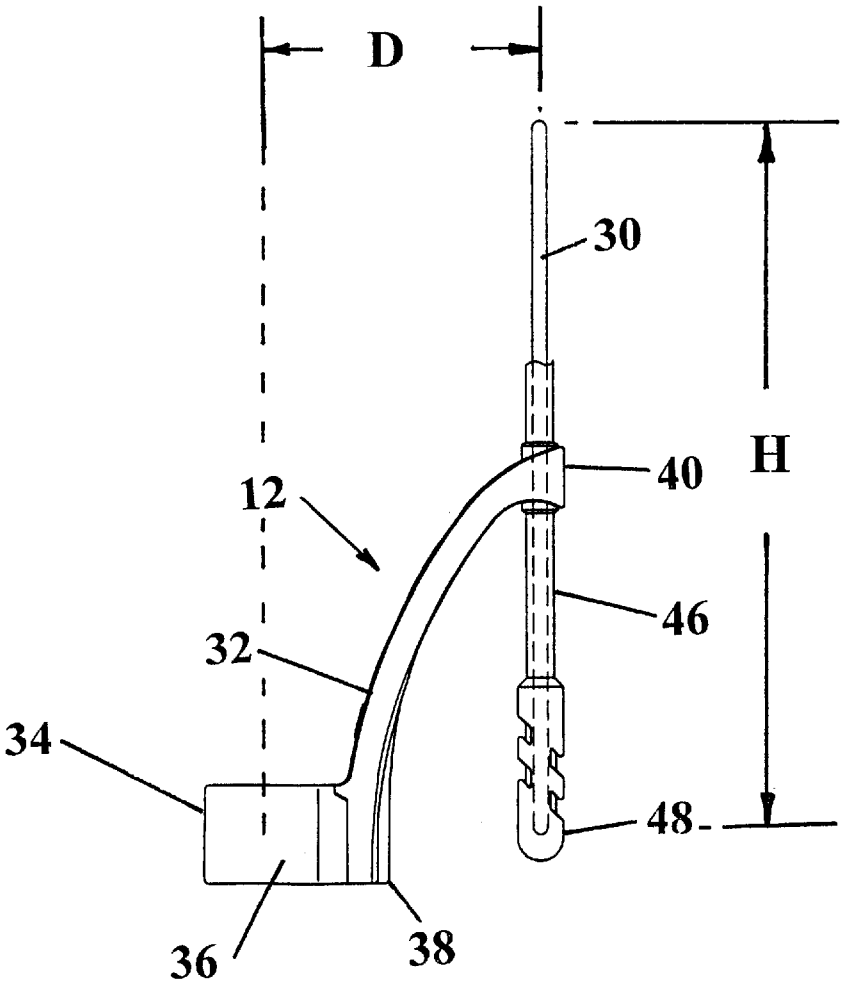
FIG. 2 illustrates a side elevational view of the antenna director element of FIG. 1.

As shown in FIGS. 1 and 2, the antenna enhancement device 12 includes an elongate conductive director element 30 and a support member 32. The antenna enhancement device 12 of FIG. 1 is illustrated in its operational position with the director element 30 substantially parallel to the active antenna element 26 and opposite the front side 20 of the PCS device 10. The support member 32 can assume a variety of configurations, styles, etc. In the illustrated embodiments of FIGS. 1–6, the support member 32 is maintained relative to the active antenna element 26 by a securement device 34, which may be a friction-fit ring 36 or similar user-removable device. In illustrated views, the support member 32 is obliquely angled with respect to the director element 30 and includes two opposed ends, a first end 38 proximate the securement device 36 and a second end 40 proximate to the conductive director element 30. The antenna enhancement device 12 may be an aftermarket device attached or otherwise secured to the PCS device 10 by the user. Alternatively, as illustrated in FIG. 7, the antenna enhancement device 12 may be an integrated structure of the radio device 10. The antenna enhancement device 12 is illustrated in its preferred operational orientation in FIG. 1 with the support member 32 maintaining the director element 30 parallel to the active antenna element 26 at the rear side 24 of the radio device 10 (away from the user's head). Support member 32 is secured near the center of the director element 30. Alternatively, the support member 32 may be secured nearer the lower end of the director element 30.

Figure 5:
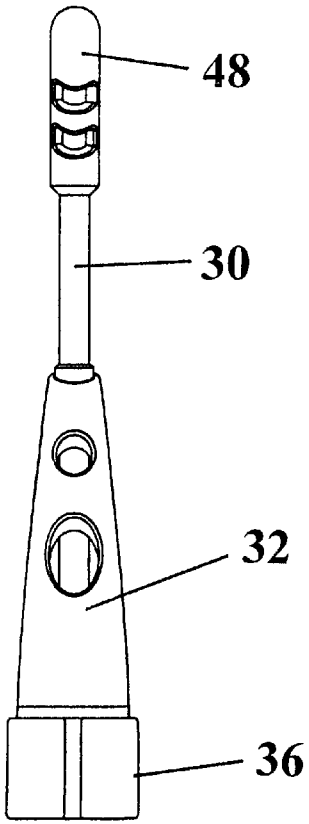
FIG. 5 illustrates a front elevational view of the antenna director element of FIG. 1.
Figure 4:
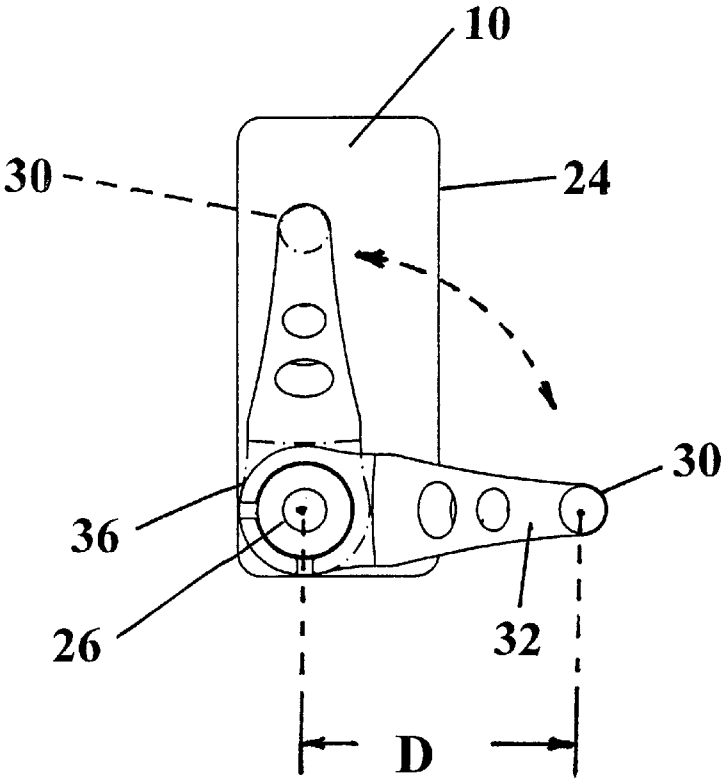
FIG. 4 illustrates a top view of the antenna director element of FIG. 1.
Figure 6:
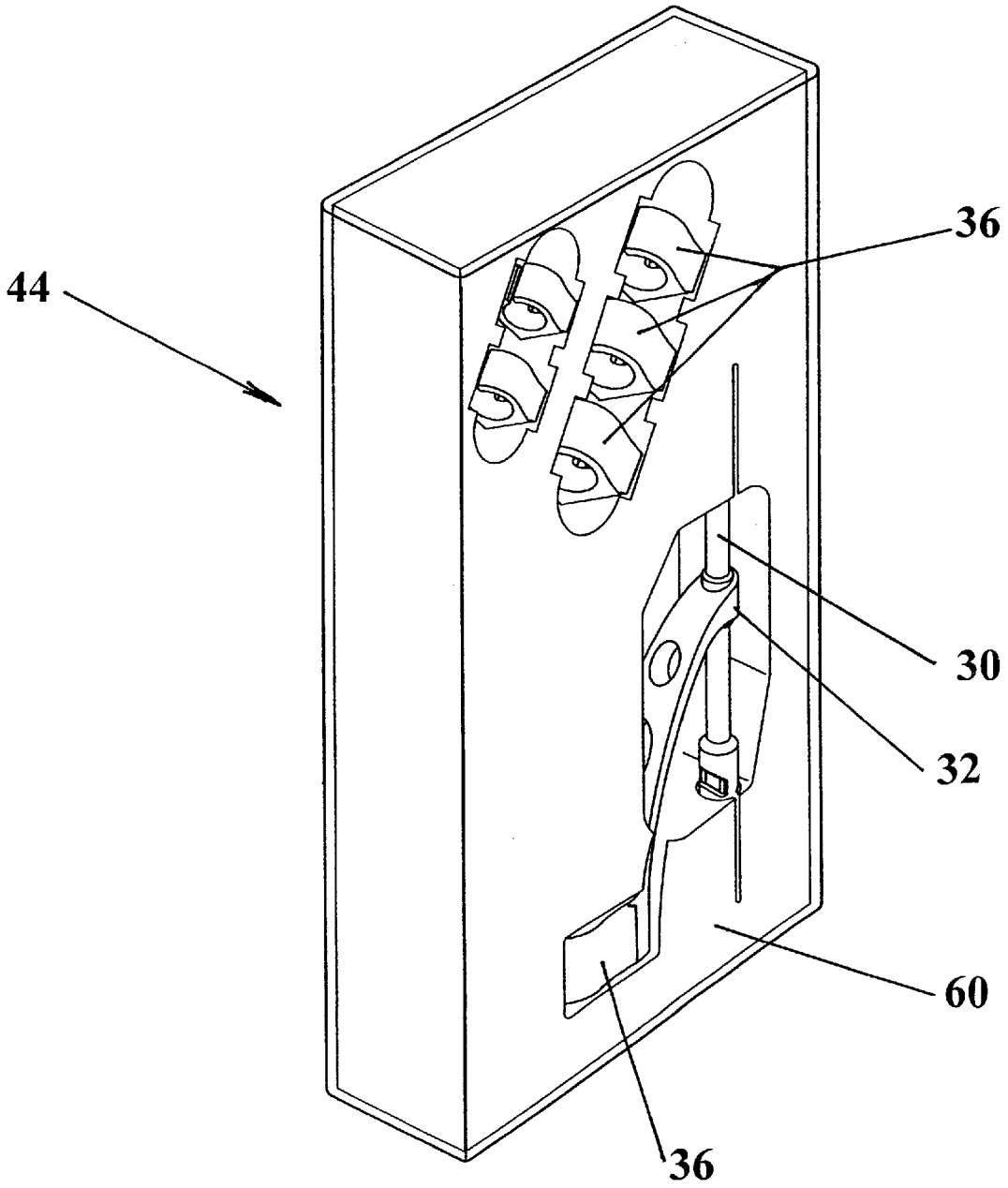
FIG. 6 is a perspective view of a kit assembly of an antenna director element and plurality of securement structures according to an aspect of the present invention.
Figure 7:
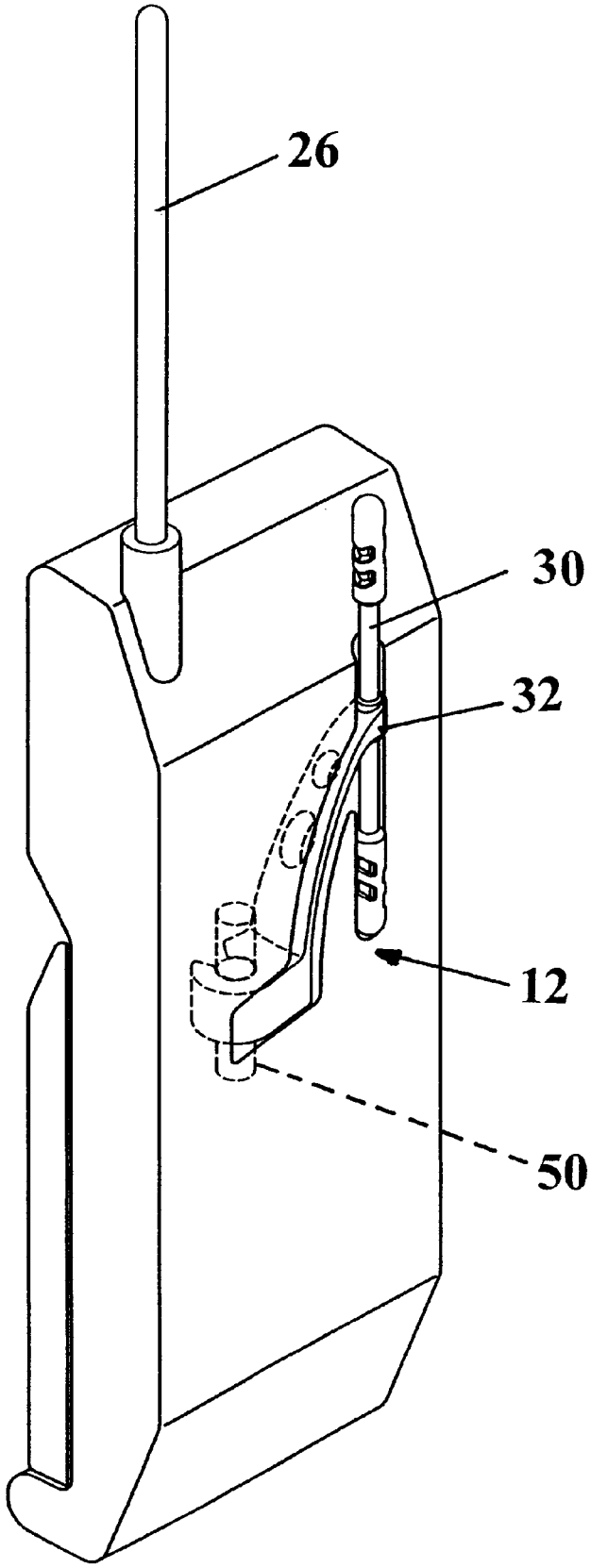
FIG. 7 is a perspective view of a cellular telephone hand-set with a second embodiment of a director element of the present invention.

Referring to FIGS. 1–6, the securement device 34 for securing the support member 32 to the active antenna member 26 is preferably a friction fit "C"—configured clamping means 36. The antenna enhancement device 12 may thus be selectively removed from the radio device 10 by the user for storage. The clamping means 36 may be a split-ring polymer element 36 which frictionally engages the active antenna element 26 to maintain the director element 30 in its operational position. FIG. 6 illustrates a kit assembly 44 which includes the support arm 32 and director element member 30 and a plurality of differently sized split-ring engaging elements 36. The kit assembly 44 of FIG. 6 depicts one packaging approach, with the individual elements retained within a foam structure 60. The split-ring engaging elements 42 are removably coupled to the first end 38 of the support arm 32 to adapt the antenna enhancement device 12 to a variety of differently transceivers 10. As depicted in FIG. 4, the antenna enhancement device 12 may be pivoted about the active antenna element 26 into an undeployed orientation for compactness when not in use. Alternatively, the antenna enhancement device 12 may be removed and stored when not in use.

Referring particularly to FIGS. 2 and 5, the parasitic director element 30 may be a short length of polymer-encapsulated metallic wire. The director element 30 may be a wire having a diameter between 0.015 inch and 0.125 inch. Director element 30 may also be formed as a small, flat conductive member. The director element 30 height, 'H', is between 0.35λ and 0.49λ (λ: a wavelength within the operational range of wavelengths). The director element 30 is spaced away from the active antenna element 26 by the support member 32 a distance 'd' of between 0.1λ to 0.25λ. Preferably, director element 30 is a wire having a 1/16 inch diameter, a height of 0.36λ and a spacing distance 'd' of 0.146λ. Director element 30 may be a metal wire and may be formed from an alloy, such as a nickel titanium composite, having "memory" characteristics so that if disturbed, the director element 30 may return to its preferred aligned operational shape. An encapsulating material 46, such as an elastic rubber, plastic, or other polymer, may encompasses the wire element 30. Protective end caps 48 are provided at the ends of the director element 30.

The support member 32 and encapsulating material 46 may be integrally formed from a dielectric plastic or plastic-type material having a dielectric constant of between 0 and 10. A further preferred range of dielectric constants for the support member is between 2 and 3. In one preferred embodiment, the support member 32 and protective end caps 48 are injection molded about a mold-inserted polyurethane-encapsulated wire element 30.

Referring now to FIG. 7, another embodiment of the radiation director device 12 is shown. The support arm 32 of the device 12 is pivotally secured to the back side 24 of the radio device 10 and is capable of being pivoted about a pivot structure 50 (from its illustrated undeployed position) into its operational position so that the support arm 32 is substantially perpendicular to the back 24 of the radio device 10. In this manner, the director element 30 can be positioned into its preferred operational orientation parallel to the active antenna element 26 and opposite the front side 20 and the user. The director element 30 of FIG. 7 may include a telescopically extendible element made of two or more segments. Additionally, the upper segment may be metallic, while the lower segment may be a dielectric material. As illustrated, the radiation director device 12 of FIG. 7 is designed to be partially received into the body of the radio device 10 (i.e., "nest") in an undeployed orientation.

The above described embodiments of the invention are merely descriptive of its principles and are not to be considered limiting. Further modifications of the invention herein disclosed will occur to those skilled in the respective arts and all such modifications are deemed to be within the scope of the invention as defined by the following claims. Examples of such modifications may include, but are not limited to, alterations of the director element, alterations of materials of construction, or inclusion of additional elements.

I claim:

1. An antenna assembly for a hand-held user operated radio frequency transceiver having an elongate active antenna element, said antenna assembly comprising:

an elongate conductive radiation director element; and a support member having a first end and second end, said first end coupled to the conductive radiation director element, said second end coupled to the transceiver, said support member having an undeployed orientation and a deployed orientation, the conductive radiation director element in parallel alignment with the elongate active antenna element and substantially opposite the user when said support member is in its deployed orientation.

2. An antenna assembly according to claim 1, wherein the active antenna element of the transceiver includes a base portion, and the second end of the support member is coupled to the transceiver proximate the base portion.

3. An antenna assembly according to claim 2, further comprising:

a clamp device at the second end of the support member for frictionally engaging the base portion of the active antenna element.

4. An antenna assembly according to claim 3, wherein the clamp device includes a plurality of differently sized split ring engaging elements.

5. An antenna assembly according to claim 1, wherein the first end of the support member is coupled near the middle of radiation director element.

6. An antenna assembly according to claim 1, wherein the radiation director element is a wire having a diameter between 0.015 inch and 0.125 inch.

7. An antenna assembly according to claim 6, wherein the radiation director element has a height dimension of between 0.35 and 0.49 times a predetermined wavelength.

8. An antenna assembly according to claim 1, wherein the radiation director element is spaced away from the active antenna element by the support member a distance of between 0.1 and 0.25 times a predetermined wavelength.

9. A movably secured antenna attachment for a hand-held radio-frequency transceiver having a front side nearer to a user and an active antenna element said antenna attachment comprising:

a conductive director element; and a support member for movably coupling the conductive director element relative to the active antenna element in an undeployed orientation and a deployed orientation, wherein the director element is substantially parallel to the active antenna element and opposite the front side of the transceiver when said support member is in its deployed orientation, and wherein the director element is nearer to the front side when in its undeployed orientation.

10. A movably secured antenna attachment according to claim 9, wherein the support member is pivotally coupled to the transceiver.

11. A movably secured antenna attachment according to claim 9, wherein the support member is movably coupled to a portion of the active antenna element.

12. A movably secured antenna attachment according to claim 11, wherein the support member is obliquely angled with respect to the active antenna element.

13. A movably secured antenna attachment according claim 11, further comprising:

a clamp device for movably coupling the support member to the portion of the active antenna element.

14. An antenna assembly according to claim 9, wherein the director element is a wire.

15. An antenna assembly according to claim 9, wherein the director element has a height dimension of between 0.35 and 0.49 times a predetermined wavelenth.

16. A selectively-attachable antenna enhancement device for a hand-held radio-frequency transceiver having a front side and an elongate active antenna element for transmitting an electromagnetic signal, said active antenna element having a base portion, said antenna enhancement device comprising:

a conductive director element; and a support member removably coupling the conductive director element to the active antenna element in a deployed orientation, wherein the director element is substantially parallel to the active antenna element and opposite the front side of the transceiver.

17. An antenna assembly according to claim 16, further comprising:

a clamp device at the second end of the support member for frictionally engaging the base portion of the active antenna element.

18. An antenna assembly according to claim 17, wherein the clamp device includes a plurality of differently sized split ring engaging elements.

19. An antenna enhancement assembly for use on one of a plurality of hand-held radio-frequency transceivers, each of said plurality of radio-frequency transceivers having an active antenna element for transmitting an electromagnetic signal, each of said active antenna elements having a differently-sized portion, said antenna enhancement assembly comprising:

a conductive director element;

a support member having a first end and a second end, said second end coupled to the conductive director element; and a structure for selectively coupling the support member and the director element relative to one of the plurality of active antenna elements, said structure including a plurality of differently-sized clamps, one of said plurality of clamps frictionally engaging the differently-sized portion of one of the plurality of active antenna elements to maintain the support member and the director element relative to the associated active antenna element.

20. An antenna assembly for a radio frequency communication device, said antenna assembly comprising:

an active antenna element having a longitudinal axis;

an elongate conductive radiation director element; and a support member having a first end and second end, said first end coupled to the director element, said support member having an undeployed orientation and a deployed orientation, said second end coupled to the active antenna element, the director element being in parallel alignment with the longitudinal axis of the active antenna element and substantially opposite the user when said support member is in its deployed orientation.

21. An antenna assembly for a radio frequency communication device according to claim 20, wherein the communication device is either a cellular telephone or a PCS device or a LAN system.

* * * * *